US009719403B2

(12) United States Patent
Yano et al.

(10) Patent No.: US 9,719,403 B2
(45) Date of Patent: Aug. 1, 2017

(54) INTERNAL COMBUSTION ENGINE EXHAUST SYSTEM SUPPORTING STRUCTURE

(71) Applicant: HONDA MOTOR CO., LTD., Tokyo (JP)

(72) Inventors: Michiya Yano, Wako (JP); Takahiro Shinkai, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 40 days.

(21) Appl. No.: 14/857,726

(22) Filed: Sep. 17, 2015

(65) Prior Publication Data

US 2016/0121711 A1 May 5, 2016

(30) Foreign Application Priority Data

Oct. 30, 2014 (JP) ..... 2014-221727

(51) Int. Cl.
*F16F 3/02* (2006.01)
*F01N 13/18* (2010.01)
*F01N 13/00* (2010.01)

(52) U.S. Cl.
CPC ..... *F01N 13/1822* (2013.01); *F01N 13/009* (2014.06); *F01N 13/011* (2014.06)

(58) Field of Classification Search
None
See application file for complete search history.

(56) References Cited

U.S. PATENT DOCUMENTS

2006/0266891 A1* 11/2006 Stammel ..... B60K 13/04 248/60

FOREIGN PATENT DOCUMENTS

| | | |
|---|---|---|
| JP | 60-124327 U | 8/1985 |
| JP | 05-098959 | 4/1993 |
| JP | 4200734 B2 | 5/2004 |

OTHER PUBLICATIONS

Japanese Office Action for corresponding JP Application No. 2014-221727, Sep. 6, 2016 (w/ English machine translation).

* cited by examiner

*Primary Examiner* — J. Allen Shriver, II
*Assistant Examiner* — Hilary L Johns
(74) *Attorney, Agent, or Firm* — Mori & Ward, LLP

(57) ABSTRACT

An internal combustion engine exhaust system supporting structure includes a body fastening portion, an exhaust fastening portion, a bracket, and a stay. The body fastening portion is provided on a power plant or a vehicle body located on a side of an exhaust passage extending from an internal combustion engine to a rear of a vehicle so that exhaust emissions flow from the internal combustion engine to the rear of the vehicle. The bracket is fastened to the body fastening portion. The stay is fastened to the exhaust fastening portion and has lower stiffness than the bracket. The bracket and the stay are fastened to each other at a connecting portion so that a vertical distance between the exhaust fastening portion and the connecting portion in a vertical direction is greater than a vertical distance between the body fastening portion and the connecting portion in the vertical direction.

20 Claims, 6 Drawing Sheets

INTERNAL COMBUSTION ENGINE EXHAUST SYSTEM SUPPORTING STRUCTURE

CROSS-REFERENCE TO RELATED APPLICATIONS

The present application claims priority under 35 U.S.C. §119 to Japanese Patent Application No. 2014-221727, filed Oct. 30, 2014, entitled "Internal Combustion Engine Exhaust System Supporting Structure." The contents of this application are incorporated herein by reference in their entirety.

BACKGROUND

1. Field

The present disclosure relates to an internal combustion engine exhaust system supporting structure.

2. Description of the Related Art

As a conventional V-engine exhaust system supporting structure, a structure for supporting an exhaust system with a single belt-like metal plate stay has been disclosed in, for example, Japanese Patent No. 4200734. In such an exhaust system supporting structure disclosed in Japanese Patent No. 4200734, a lower end of a catalytic converter connected to an exhaust pipe of one of the banks is fastened with a single metal plate stay to a boss on the bottom of an oil pan. Also, a lower end of a catalytic converter connected to an exhaust pipe of the other bank is fastened with a single metal plate stay to a boss on the bottom of the oil pan.

SUMMARY

According to one aspect of the present invention, an internal combustion engine exhaust system supporting structure having an exhaust passage that extends from an internal combustion engine to the rear of a vehicle so as to lead exhaust emissions from the internal combustion engine to the rear of the vehicle and an exhaust emission control device that is provided in the exhaust passage so as to purify exhaust emissions includes a body fastening portion, an exhaust fastening portion, a bracket, and a stay. The body fastening portion is provided on a power plant or a portion of a vehicle body located on the side of the exhaust passage. The exhaust fastening portion is provided on the top of the exhaust passage. The bracket is fastened to the body fastening portion. The stay is fastened to the exhaust fastening portion and has lower stiffness than the bracket. The bracket and the stay are fastened to each other at a connecting portion, and a vertical distance between the exhaust fastening portion and the connecting portion is configured to be greater than a vertical distance between the body fastening portion and the connecting portion.

According to another aspect of the present invention, an internal combustion engine exhaust system supporting structure includes a body fastening portion, an exhaust fastening portion, a bracket, and a stay. The body fastening portion is provided on a power plant or a vehicle body located on a side of an exhaust passage extending from an internal combustion engine to a rear of a vehicle so that exhaust emissions flow from the internal combustion engine to the rear of the vehicle. The exhaust passage has a top outside the exhaust passage in a vertical direction. The exhaust fastening portion is provided on the top of the exhaust passage. The bracket is fastened to the body fastening portion. The stay is fastened to the exhaust fastening portion and has lower stiffness than the bracket. The bracket and the stay are fastened to each other at a connecting portion so that a vertical distance between the exhaust fastening portion and the connecting portion in the vertical direction is greater than a vertical distance between the body fastening portion and the connecting portion in the vertical direction.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DESCRIPTION OF THE EMBODIMENTS

Figure 1:
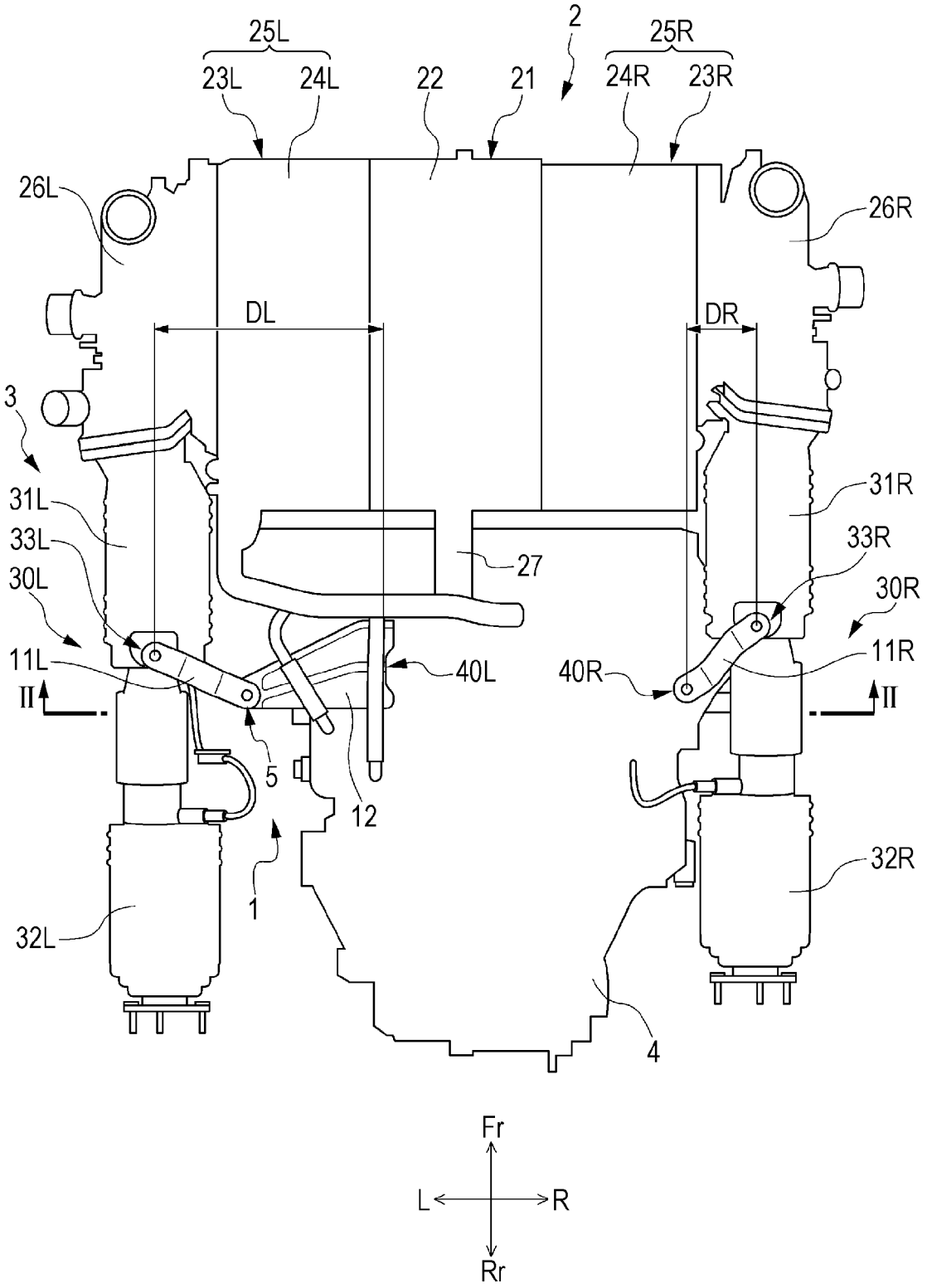
FIG. 1 is a plan view of an internal combustion engine exhaust system supporting structure according to an embodiment of the present disclosure.

The embodiments will now be described with reference to the accompanying drawings, wherein like reference numerals designate corresponding or identical elements throughout the various drawings.

An embodiment of the present disclosure is described below with reference to the attached drawings. FIG. 1 is a plan view of an internal combustion engine exhaust system supporting structure according to an embodiment of the present disclosure. As shown in FIG. 1, an internal combustion engine exhaust system supporting structure 1 according to the embodiment is applied to an exhaust system 3 of a V-engine 2. In FIG. 1, reference to "vehicle front (Fr)", "vehicle rear (Rr)", right (R)", or "left (L)" is relative to a driver's position.

The engine 2 as an internal combustion engine is a 6-cylinder V-engine. The engine 2 has an engine block 21, a cylinder block 22, a pair of left-side and right-side cylinder heads 23L, 23R mounted on the cylinder block 22 so as to form a bank angle of, for example, 90 degrees therebetween, and head covers 24L, 24R mounted on the cylinder heads 23L, 23R, respectively.

The left-side cylinder head 23L and the left-side head cover 24L constitute a left-side bank 25L. Likewise, the right-side cylinder head 23R and the right-side head cover 24R constitute a right-side bank 25R.

The left-side bank 25L has three cylinders (not illustrated) equally spaced along a longitudinal axis of a vehicle. The left-side bank 25L has a left-side exhaust manifold 26L connected thereto on the outside (left side) thereof and the exhaust manifold 26L is connected to a left-side exhaust pipe 30L forming an exhaust system 3 to be described later. In other words, the cylinders are connected to the left-side exhaust pipe 30L via the left-side exhaust manifold 26L.

Likewise, the right-side bank 25R has three cylinders (not illustrated) equally spaced along a longitudinal axis of a vehicle. The right-side bank 25R has a right-side exhaust manifold 26R connected thereto on the outside (right side) thereof and the exhaust manifold 26R is connected to a right-side exhaust pipe 30R forming the exhaust system 3 to be described later. In other words, the cylinders are connected to the right-side exhaust pipe 30R via the right-side exhaust manifold 26R.

The cylinder block 22 is connected at a rear end thereof to a transmission 4 via a crankshaft 27. The transmission 4 has a cross-sectional area that decreases toward a rear end of a vehicle.

The exhaust system 3 includes the left-side exhaust pipe 30L, a left-side first catalytic converter 31L, and a left-side second catalytic converter 32L, the first and second catalytic converters 31L, 32L being mounted in the left-side exhaust pipe 30L so as to function as an exhaust emission control device. The exhaust system 3 also includes the right-side exhaust pipe 30R, a right-side first catalytic converter 31R, and a right-side second catalytic converter 32R, the first and second catalytic converters 31R, 32R being mounted in the right-side exhaust pipe 30R so as to function as an exhaust emission control device.

The left-side exhaust pipe 30L is connected to a downstream end of the left-side exhaust manifold 26L and extends from the downstream end toward the rear of the vehicle. The left-side first catalytic converter 31L and the left-side second catalytic converter 32L are arranged in the left-side exhaust pipe 30L in this order from an upstream side.

The right-side exhaust pipe 30R and the right-side first catalytic converter 31R and the second catalytic converter 32R, the catalytic converters 31R, 32R being exhaust emission control devices mounted in the right-side exhaust pipe 30R, are configured in the same manner as the left side, except that a left-side connection between the left-side exhaust pipe 30L and the left-side exhaust manifold 26L is offset to the rear of the vehicle relative to its right-side counterpart due to differences in shape between the right-side and left-side banks/exhaust manifolds.

The catalytic converter is a cylindrically-shaped metal case containing a cylindrically-shaped catalyst support of a honeycomb structure that supports, for example, a three-way catalyst or other exhaust gas purification catalyst. Due to its high weight, the catalytic converter vibrates substantially vertically in conjunction with the vibrations of the engine 2, causing the exhaust pipe to vibrate substantially vertically as well.

In this embodiment, the exhaust system supporting structure 1 is applied to a left-side exhaust system of the exhaust system 3. The exhaust system supporting structure 1 has a stay 11L, a bracket 12, an exhaust fastening portion 33L, a body fastening portion 40L, and a connecting portion 5.

The stay 11L is fastened with a bolt (not illustrated) to the exhaust fastening portion 33L provided on top of the left-side exhaust pipe 30L. The bracket 12 is fastened with a bolt (not illustrated) to the body fastening portion 40L provided on the left-side upper outer wall of the transmission 4 on the side of the left-side exhaust pipe 30L. The stay 11L and the bracket 12 are fastened to each other at the connecting portion 5 with a bolt (not illustrated).

The right-side exhaust system is supported by a stay 11R. Specifically, one of the ends of the stay 11R is fastened with a bolt (not illustrated) to an exhaust fastening portion 33R provided on top of the right-side exhaust pipe 30R, while the other end is fastened with a bolt (not illustrated) to a body fastening portion 40R provided on the right-side upper outer wall of the transmission 4. As shown in FIG. 1, a distance DL between the exhaust fastening portion 33L and the body fastening portion 40L (a distance between the left-side exhaust pipe 30L and the body fastening portion 40L of the transmission 4 as a power plant) is greater than a distance DR between the right-side exhaust pipe 30R and the body fastening portion 40R (a distance between the right-side exhaust pipe 30R and the body fastening portion 40R of the transmission 4). Conventionally, a stay that supports the left-side exhaust system has a larger overhang (a sideways projection of the stay from the power plant when viewed from the top) than a stay that supports the right-side exhaust system. The exhaust system supporting structure according to this embodiment, however, uses the bracket 12 in addition to the stay 11L, which significantly reduces the overhang of the stay 11L, resulting in an overhang equal to that of the right-side stay 11R. This avoids damage to the fastening portion arising from the vibrations of the catalytic converters.

The stay 11L is made of a belt-like steel plate having a certain width. The stay 11L is configured to have lower stiffness than the bracket 12 to be described later. For the purpose of the description, the term "stiffness" is defined as the extent to which an object resists a dimensional change (deformation) in response to a bending or torsional force. Specifically, stiffness is represented by a force (load/deformation amount) required to cause unit deformation and is measured by a known measurement method.

The bracket 12 is made of a belt-like aluminum plate. Due to its material, the bracket 12 according to this embodiment is lightweight despite being ribbed and thick enough to have higher stiffness than the steel stay 11L, as described later. The bracket 12 is manufactured by, for example, aluminum casting.

Figure 2:
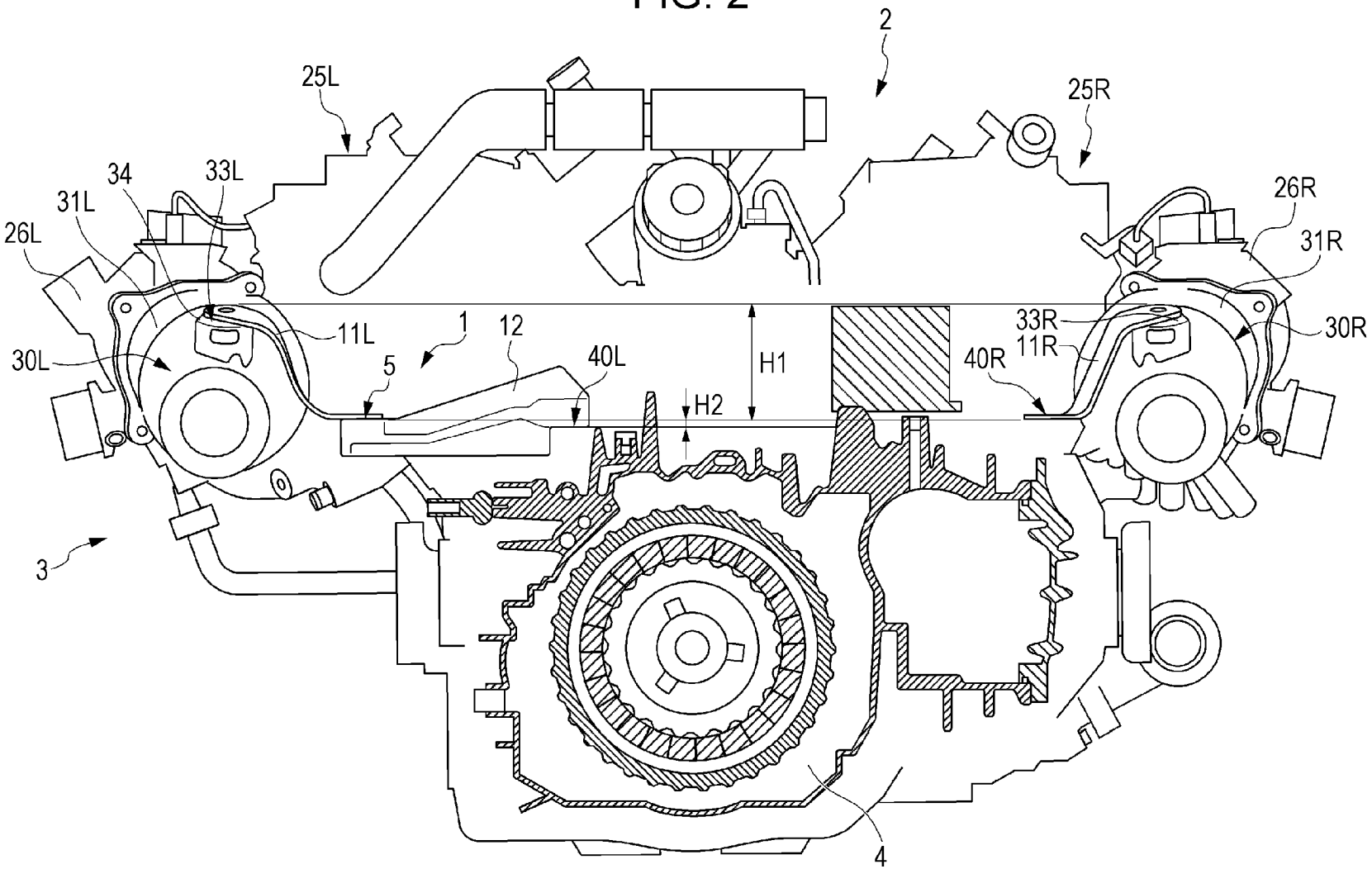
FIG. 2 is a sectional view taken along the line II-II of FIG. 1.

FIG. 2 is a sectional view taken along the line II-II of FIG. 1. As shown in FIG. 2, a vertical distance H1 between the exhaust fastening portion 33L and the connecting portion 5 is configured to be greater than a vertical distance H2 between the body fastening portion 40L and the connecting portion 5 in this embodiment. In other words, the vibrations of the left-side exhaust pipe 30L resulting from the vibrations of the heavy catalytic converter are configured to be preferentially absorbed by the stay 11L that is located at a greater vertical distance and that has lower stiffness.

As shown in FIG. 2, a vertical distance between the exhaust fastening portion 33R and the body fastening portion 40R is configured to be equal to H1 in this embodiment. In other words, the left-side and right-side stays 11L, 11R have the same vertical dimension, enabling the component structure to be common to both sides.

Figure 3:
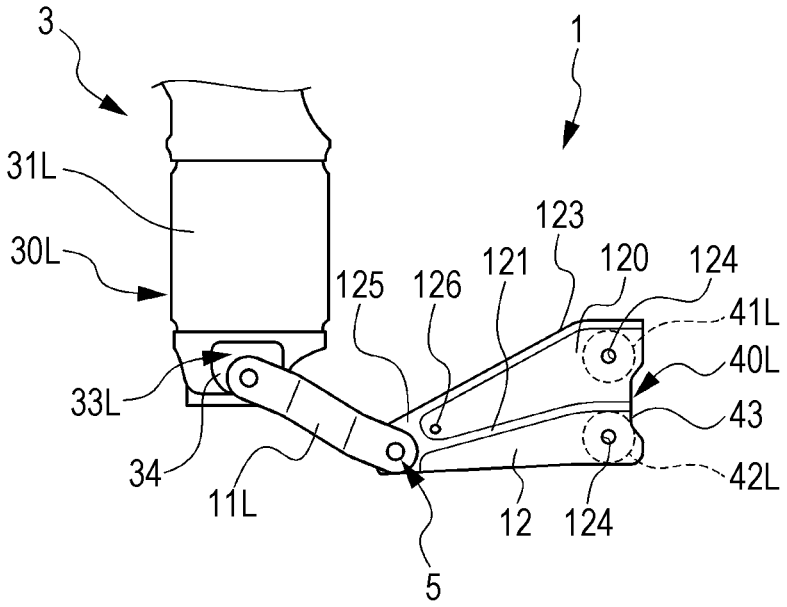
FIG. 3 is an enlarged view of a stay and a bracket according to the embodiment shown in FIG. 1.
Figure 4:
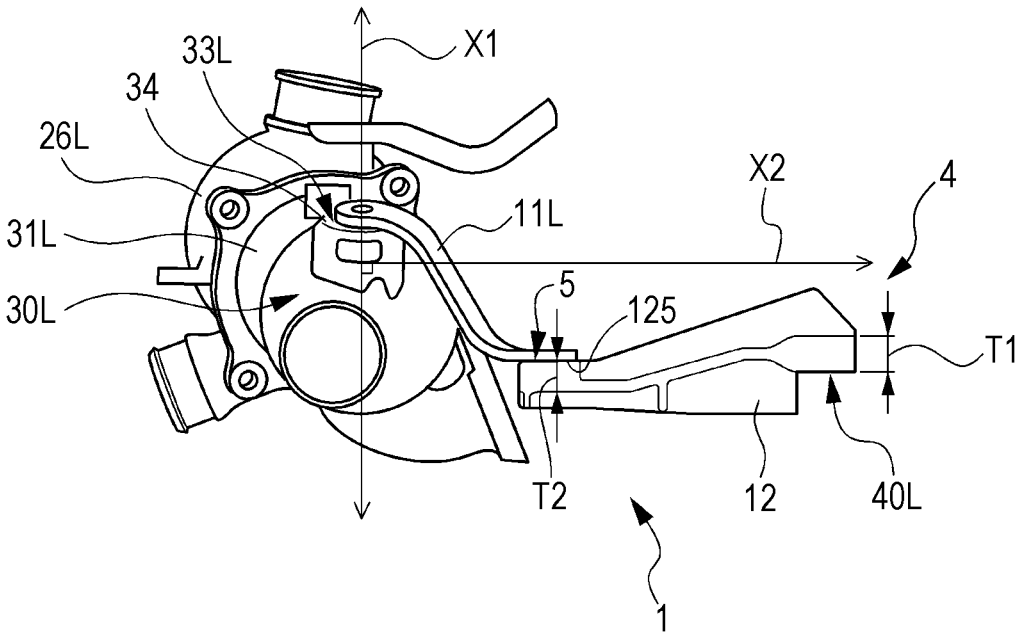
FIG. 4 is an enlarged view of a stay and a bracket according to the embodiment shown in FIG. 2.
Figure 5:
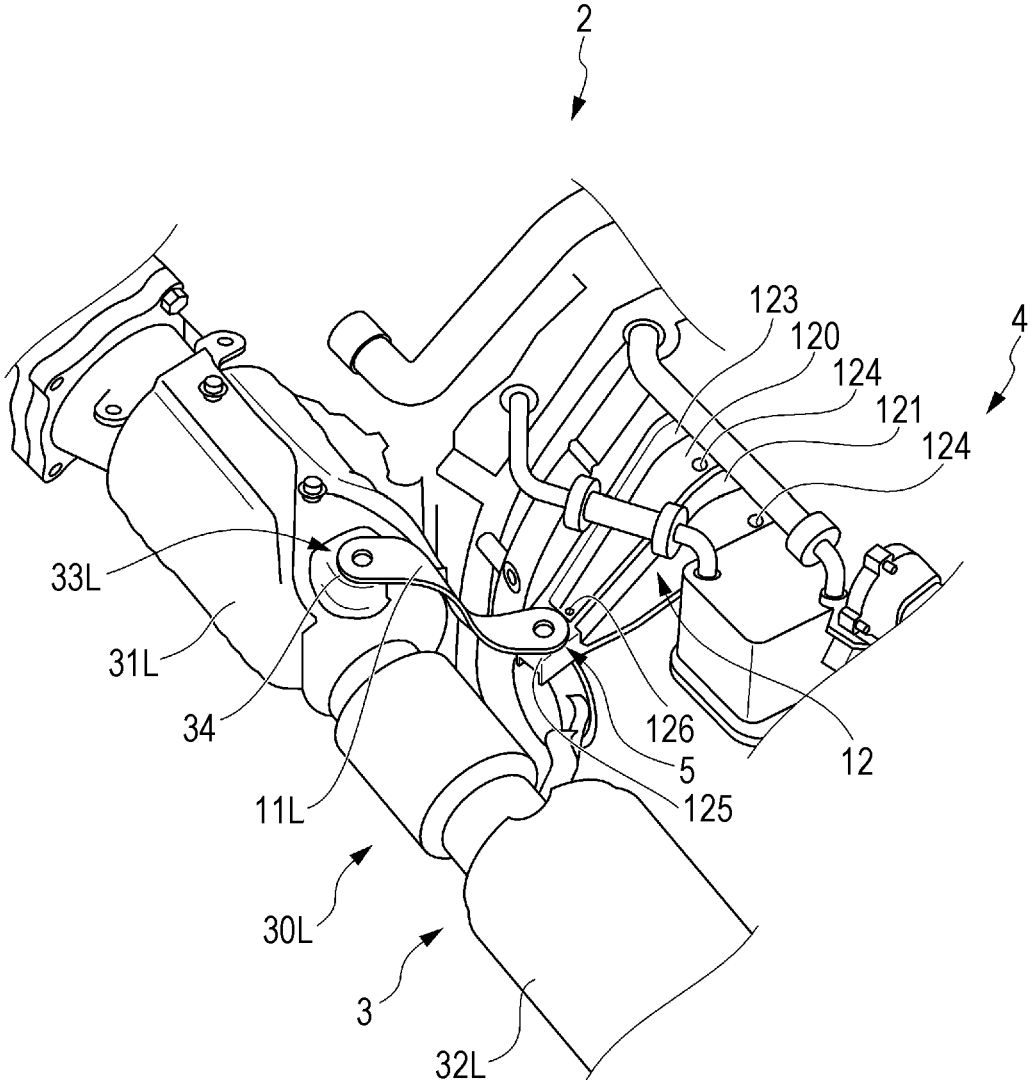
FIG. 5 is a perspective view of an internal combustion engine exhaust system supporting structure according to the embodiment.

FIG. 3 is an enlarged view of the stay 11L and the bracket 12 according to the embodiment shown in FIG. 1. FIG. 4 is an enlarged view of the stay 11L and the bracket 12 according to the embodiment shown in FIG. 2. FIG. 5 is a perspective view of an internal combustion engine exhaust system supporting structure 1 according to the embodiment. As shown in FIG. 3, the bracket 12 has a first rib 121 extending from the connecting portion 5 toward the body fastening portion 40L. The first rib 121 is formed on an upper surface and a lower surface of a plate-like portion 120 (a plate-shaped portion 120) forming the bracket 12 so as to penetrate through the plate-like portion 120 (see FIG. 7 to be described later).

As shown in FIG. 4, the first rib 121 extends in the direction (indicated by an arrow X2 in FIG. 4) substantially perpendicular to the direction (indicated by an arrow X1 in FIG. 4) in which the left-side exhaust pipe 30L vibrates in response to the vibrations of the catalytic converter. With this arrangement the first rib 121 improves the stiffness of the bracket 12 despite being lightweight due to its aluminum material. The first rib 121 extends to a connecting surface 43 between the bracket 12 and the transmission 4 through a gap between two body fastening seating surfaces 41L, 42L (to be described later) disposed immediately below two fastening holes 124, 124 formed in the plate-like portion 120 on the side of the transmission 4. This arrangement further improves the stiffness of the bracket 12.

As shown in FIG. 3, the bracket 12 has a bracket seating surface 125 formed in the connecting portion 5 connected to the stay 11L. The bracket seating surface 125 has a fastening hole 127 formed therein (see FIG. 7 to be described later). The bracket 12 has the same width as the bracket seating surface 125 in the connecting portion 5. Also, the bracket 12 widens from the connecting portion 5 toward the body fastening portion 40L, leading to the width being equal to a dimension between the outer ends of the body fastening seating surfaces 41L, 42L. In other words, while having a seating surface range required for being fastened to the stay 11L and the transmission 4, the bracket 12 is shaped to ensure that no part of the bracket 12 protrudes from a tangent line of the seating surface range.

A third rib 123 is formed at the front end of bracket 12 so as to extend along the rib 121 described above. The third rib 123 further improves the stiffness of the bracket. In addition, a drainage hole 126 is formed on the side of the connecting portion 5 in the plate-like portion 120 enclosed by the first rib 121 and the third rib 123. As shown in FIGS. 4 and 5, the plate-like portion 120 is sloped upward from the connecting portion 5 toward the body fastening portion 40L, in which water is configured to flow down on the plate-like portion 120 and drain through the drainage hole 126. A second rib 122 to be described later is formed only in the lower surface of the plate-like portion 120 to enable water to drain through the drainage hole 126.

As shown in FIGS. 4 and 5, the exhaust fastening portion 33L provided on top of the left-side exhaust pipe 30L has a exhaust fastening seating surface 34 of a tilted surface formed on an upper surface of a boss. The exhaust fastening seating surface 34 is sloped downward toward the rear of the vehicle, while an end on the side of the exhaust fastening portion 33L of the stay 11L fastened to the exhaust fastening seating surface 34 is sloped upward so as to extend toward the exhaust fastening portion 33L. The stay 11L is disposed in such a manner that an end on the side of the connecting portion 5 is offset toward the rear of the vehicle relative to the other end on the side of the exhaust fastening portion 33L. With this arrangement, the shape of the stay 11L can be simplified by sloping the end of the stay 11L on the side of the exhaust fastening portion 33L.

As shown in FIG. 4, the plate-like portion 120 of the bracket 12 has a thickness at a seating surface portion around the fastening holes 124, 124, 127 that is greater than the thickness at other portions (T1 and T2 of FIG. 4). To cope with stress occurring around the seating surface, the bracket 12 according to this embodiment has enhanced stiffness through the thickened seating surface portion.

Figure 6:
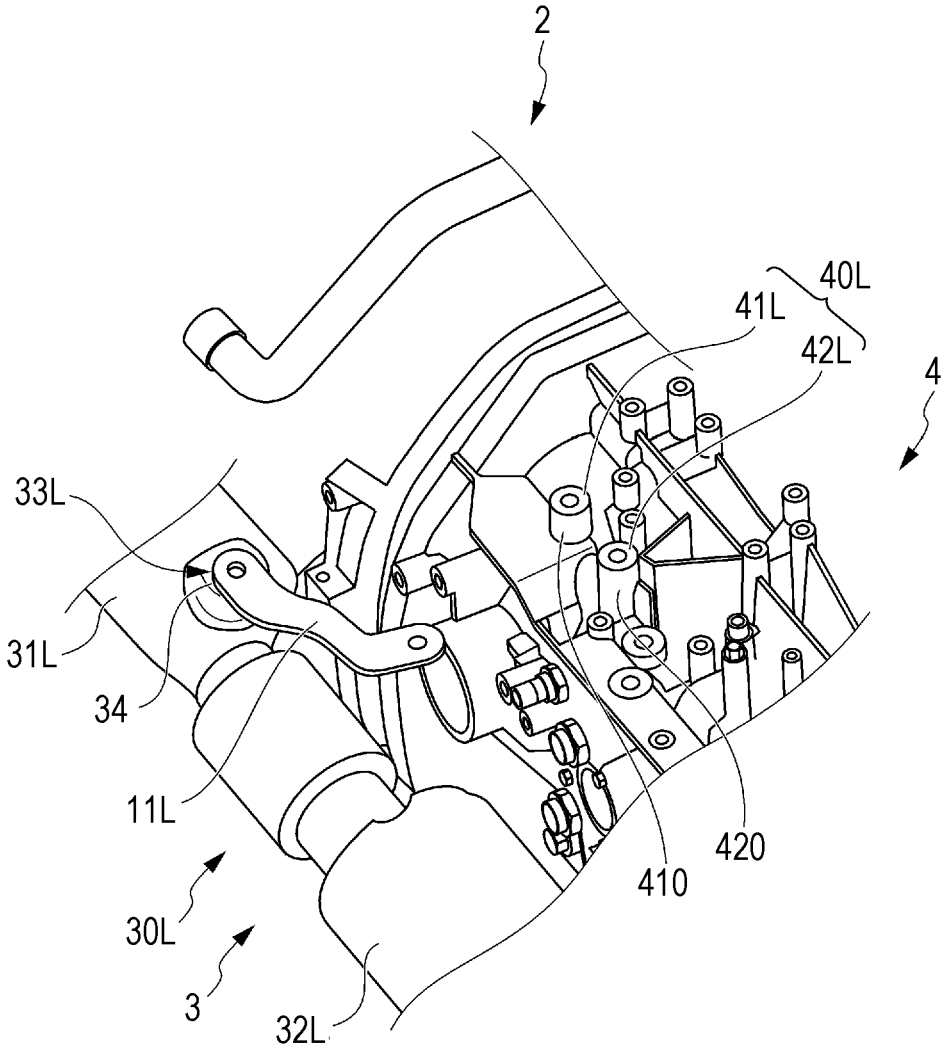
FIG. 6 is a perspective view of an internal combustion engine exhaust system supporting structure according to the embodiment with the bracket removed.

FIG. 6 is a perspective view of an internal combustion engine exhaust system supporting structure 1 according to the embodiment with the bracket 12 removed. As shown in FIG. 6, the body fastening portion 40L provided on the transmission 4 has two body fastening seating surfaces 41L, 42L that are spaced apart from each other. The body fastening seating surfaces 41L, 42L are formed in the upper surface of the two cylindrically-shaped bosses 410, 420. With this arrangement, the first rib 121 can be extended to the connecting surface 43 between the bracket 12 and the transmission 4.

Figure 7:
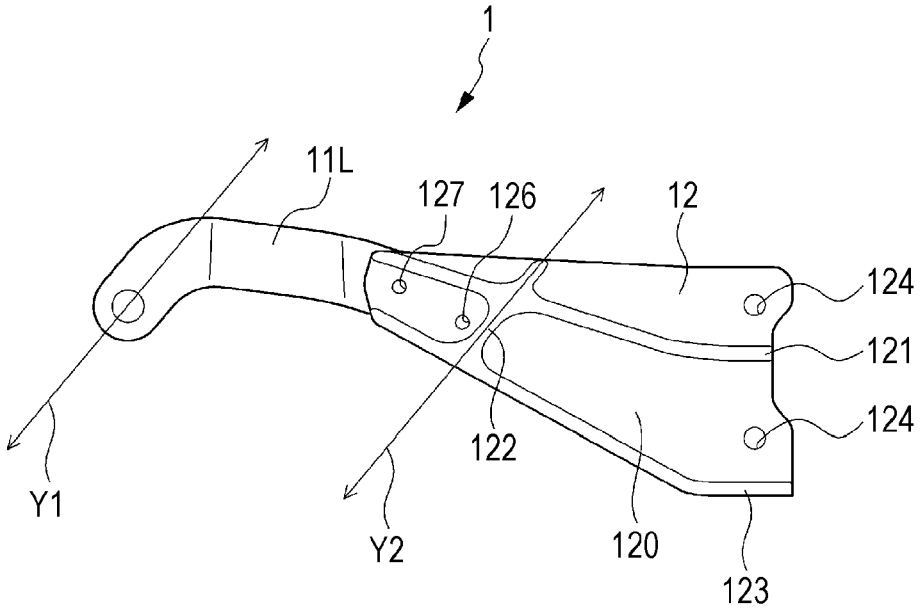
FIG. 7 is a bottom view of a stay and a bracket according to the embodiment.

FIG. 7 is a bottom view of the stay 11L and the bracket 12 according to the embodiment. As shown in FIG. 7, the bracket 12 has the second rib 122 formed in the lower surface (under surface) of the plate-like portion 120. The second rib 122 extends (in the direction indicated by "Y2" of FIG. 7) in the direction (indicated by "Y1" of FIG. 7) in which the end on the side of the exhaust fastening portion 33L of the stay 11L extends. This prevents the bracket 12 from being twisted due to the vibrations of the left-side exhaust pipe 30L.

The embodiment has the following advantages. In the embodiment, the bracket 12 fastened to the body fastening portion 40L provided on the transmission 4 and the stay 11L that is fastened to the exhaust fastening portion 33L provided on the top of the left-side exhaust pipe 30L and that has lower stiffness than the bracket 12 are fastened to each other at the connecting portion 5. In addition, a vertical distance between the exhaust fastening portion 33L and the connecting portion 5 is configured to be greater than a vertical distance between the body fastening portion 40L and the connecting portion 5. With this arrangement, the vibrations of the left-side exhaust pipe 30L resulting from the vibrations of the heavy left-side first and second catalytic converters 31L, 32L are configured to be preferentially absorbed by the stay 11L that is located at a greater vertical distance and that has lower stiffness. In addition, the highly rigid bracket 12 is used to fasten the stay 12 to the transmission 4, which can avoid damage to the fastening portions and robustly support the exhaust system 3 even if the exhaust system 3 is far away from the body fastening portion 40L on the transmission 4.

As described in the embodiment above, in cases where two catalytic converters are disposed just below the V-engine 2 on the left and right sides, respectively, a distance between the catalytic converter (exhaust system 3) provided in the exhaust pipe for each bank and the body fastening portion on the transmission 4 may differ between left-side and right-side banks due to the shape and layout of the transmission 4. This may also cause the stays for supporting the left-side and right-side exhaust systems to have a different shape and overhang (a dimension of the stay projecting sideways from the power plant when viewed from the top) between both banks, causing a difference in thermal stress of the stays between both banks due to stiffness of the stays and thermal elongation of the catalytic converters. As a result, the stays cannot be shared by both banks, resulting in an increased man-hours and costs in component development and manufacture. On the other hand, the exhaust system supporting structure 1 according to the embodiment can shorten the overhang of the stay 11L in the left-side bank 25L where the exhaust fastening portion on the exhaust pipe is far away from the body fastening portion on the transmission 4, namely, the overhang of the stay is more elongated. Furthermore, a stay structure can be shared by both banks, thereby reducing costs.

In the embodiment, the bracket 12 has the first rib 121 that extends from the connecting portion 5 to the body fastening portion 40L and further extends in the direction substantially perpendicular to the direction in which the left-side exhaust pipe 30L vibrates in conjunction with the vibrations of the catalytic converter. This improves the stiffness of the bracket 12 in the direction in which the left-side exhaust pope 30L vibrates, thereby enabling the exhaust system 3 to be supported more reliably.

In the embodiment, the body fastening portion 40L has at least two body fastening seating surfaces 41L, 42L spaced apart from each other. The first rib 121 extends to the connecting surface 43 between the bracket 12 and the transmission 4 through a gap between the at least two body fastening seating surfaces 41L, 42L. This further improves the stiffness of the bracket 12 in the direction in which the left-side exhaust pipe 30L vibrates, thereby enabling the exhaust system 3 to be supported more reliably.

In the embodiment, the bracket 12 has the bracket seating surface 125 provided in the connecting portion 5 thereof and is configured to have the same width as the bracket seating surface 125 at the connecting portion 5 and widen from the connecting portion 5 toward the body fastening portion 40L. With this arrangement, the bracket 12 has the largest width on the side of the body fastening portion 40L, thereby enabling the bracket 12 to be more robustly fastened to avoid damage. In addition, the weight and cost of the bracket 12 can be reduced while maintaining the width required for fastening.

In the embodiment, the exhaust fastening seating surface 34 formed of an inclined surface is provided in the exhaust fastening portion 33L. With this arrangement, the end of the stay 11L is inclined on the side of the exhaust fastening portion 33L, thereby reducing the section modulus of the stay 11L in the direction in which the catalytic converter expands due to heat. In other words, the rate of restriction of the stay 11L as a result of expansion of the catalytic converter due to heat can be reduced. Accordingly, the stay 11L can, through its surface, receive and absorb deformation resulting from expansion due to heat more reliably, which can certainly reduce the chance of damage to the fastening portions and more robustly support the exhaust system 3.

In the embodiment, the stay 11L is disposed in such a manner that an end on the side of the connecting portion 5 is offset toward the rear of the vehicle relative to the other end on the side of the exhaust fastening portion 33L. This arrangement enables simplification of the shape of the stay 11L and cost reduction by sloping the end of the stay 11L on the side of the exhaust fastening portion 33L.

In the embodiment, the second rib 122 extending in the direction in which an end on the side of the exhaust fastening portion 33L of the stay 11L extends is provided in the bracket 12. This prevents the bracket 12 from being twisted due to the vibrations of the left-side exhaust pipe 30L resulting from the vibrations of the catalytic converter, further enhancing the stiffness of the bracket 12. Accordingly, the chance of damage can be certainly reduced and the exhaust system 3 can be more robustly supported.

The present disclosure is typically described with reference to, but not limited to, the foregoing embodiment. Various modifications are conceivable within the scope of the present. The bracket is fastened to the body fastening portion provided on the transmission as a power plant in the above embodiment, but is not limited to this. For example, for the exhaust pipe and the like that are provided at a location not affected by the vibrations, the bracket may be fastened to the body fastening portion provided on the vehicle body. The body fastening portion has two body fastening seating surfaces spaced apart from each other in the above embodiment, but is not limited to this. The body fastening portion may have three or more body fastening seating surfaces.

According to a first aspect of the present application, an internal combustion engine exhaust system (for example, an exhaust system 3 to be described later) supporting structure (for example, an internal combustion engine exhaust system supporting structure 1 to be described later) having an exhaust passage (for example, a left-side exhaust pipe 30L) that extends from an internal combustion engine (for example, an engine 2 to be described later) to the rear of a vehicle so as to lead exhaust emissions from the internal combustion engine to the rear of the vehicle and an exhaust emission control device (for example, a left-side first catalytic converter 31L or a left-side second catalytic converter 32L to be described later) that is provided in the exhaust passage so as to purify exhaust emissions includes a body fastening portion (for example, a body fastening portion 40L to be described later) provided on a power plant or a vehicle body (for example, a transmission 4 as a power plant to be described later) located on the side of the exhaust passage, an exhaust fastening portion (for example, an exhaust fastening portion 33L to be described later) provided on the top of the exhaust passage, a bracket (for example, a bracket 12 to be described later) fastened to the body fastening portion, and a stay (for example, a stay 11L to be described later) that is fastened to the exhaust fastening portion and that has lower stiffness than the bracket. In such a supporting structure, the bracket and the stay are fastened to each other at a connecting portion (for example, a connecting portion 5 to be described later) and a vertical distance (for example, a distance H1 to be described later) between the exhaust fastening portion and the connecting portion (for example, a distance H2 to be described later) is configured to be greater than a vertical distance between the body fastening portion and the connecting portion.

In the present application, a bracket fastened to a body fastening portion provided on a power plant or a vehicle body and a stay that is fastened to an exhaust fastening portion provided on the top of an exhaust passage and that has lower stiffness than the bracket are fastened to each other at a connecting portion. A vertical distance between the exhaust fastening portion and the connecting portion is configured to be greater than a vertical distance between the body fastening portion and the connecting portion. With this arrangement, the vibrations of the exhaust passage resulting from the vibrations of the heavy catalytic converter or other exhaust emission control device are configured to be preferentially absorbed by the stay that is located at a greater vertical distance and that has lower stiffness. In addition, the highly rigid bracket is used to fasten the stay to the power plant or the vehicle body, which can avoid damage to the fastening portions and robustly support the exhaust system even if the exhaust system is far away from the power plant or the body fastening portion.

In cases where two catalytic converters or other emission control devices are disposed just below, for example, a V-engine, a distance between the exhaust emission control device (exhaust system) provided in the exhaust pipe for each bank and a fastening portion provided on the power plant may differ between left-side and right-side banks due to the shape and layout of the engine, transmission, or other power plant. This may also cause the stays for supporting the exhaust systems to have a different shape and overhang (a dimension of the stay projecting sideways from the power plant when viewed from the top) between both banks, causing a difference in thermal stress of the stays between both banks due to stiffness of the stays and thermal elongation of the catalytic converters. As a result, the stays cannot be shared by both banks, resulting in increased man-hours and costs in component development and manufacture. On the other hand, the exhaust system supporting structure according to the first aspect of the present application can shorten the overhang of the stay in a bank where a fastening portion on a catalytic converter or other exhaust emission control device is far away from a fastening portion provided on the power plant, namely, the overhang of the stay is more elongated. Furthermore, a stay structure can be shared by both banks, thereby reducing costs.

According to a second aspect of the present application, the bracket may have a first rib (for example, a first rib 121 to be described later) extending from the connecting portion to the body fastening portion. Preferably, the first rib extends in a direction (for example, a direction indicated by "X2" to be described later) substantially perpendicular to a direction (for example, a direction indicated by "X1" to be described later) in which the exhaust passage vibrates in conjunction with the vibrations of the exhaust emission control device.

In the present application, the bracket has a first rib that extends from the connecting portion to the body fastening portion and further extends in a direction substantially perpendicular to a direction in which the exhaust passage vibrates in conjunction with the vibrations of the exhaust emission control device. This improves the stiffness of the bracket in the direction in which the exhaust passage vibrates, thereby enabling the exhaust system to be supported more reliably.

According to a third aspect of the present application, the body fastening portion may have at least two body fastening seating surfaces (for example, body fastening seating surfaces 41L, 42L to be described later) spaced apart from each other. Preferably, the first rib extends to a connecting surface (for example, a connecting surface 43 to be described later) between the bracket and the power plant or the vehicle body through a gap between the at least two body fastening seating surfaces.

In the present application, at least two body fastening seating surfaces spaced apart from each other are provided in the body fastening portion. In addition, the first rib extends to a connecting surface between the bracket and the power plant or the vehicle body through a gap between the body fastening seating surfaces. This further improves the stiffness of the bracket in the direction in which the exhaust passage vibrates, thereby enabling the exhaust system to be supported more reliably.

According to a fourth aspect of the present application, the bracket may have a bracket seating surface (for example, a bracket seating surface 125 to be described later) formed in the connecting portion. Preferably, the bracket has the same width as the bracket seating surface at the connecting portion and widens from the connecting portion toward the body fastening portion.

In the present application, the bracket has a bracket seating surface provided in the connecting portion thereof and is configured to have the same width as the bracket seating surface at the connecting portion and widen from the connecting portion toward the body fastening portion. With this arrangement, the bracket has the largest width on the side of the body fastening portion, thereby enabling the bracket to be more robustly fastened to avoid damage. In addition, the weight and cost of the bracket can be reduced while maintaining the width required for fastening.

According to a fifth aspect of the present application, the exhaust fastening portion preferably has an exhaust fastening seating surface (for example, an exhaust fastening seating surface 34 to be described later) formed of an inclined surface.

In the present application, an exhaust fastening seating surface formed of an inclined surface is provided in the exhaust fastening portion. With this arrangement, the end of the stay is inclined on the side of the exhaust fastening portion, thereby reducing the section modulus of the stay in the direction in which the catalytic converter or other exhaust emission control device expands due to heat. In other words, the rate of restriction of the stay as a result of expansion of the catalytic converter or other exhaust emission control device due to heat can be reduced. Accordingly, the stay can, through its surface, receive and absorb deformation resulting from expansion due to the heat more reliably, which can certainly reduce the chance of damage to the fastening portions and more robustly support the exhaust system.

According to a sixth aspect of the present application, the stay is preferably disposed in such a manner that an end thereof on the side of the connecting portion is offset toward the rear of the vehicle relative to the other end on the side of the exhaust fastening portion.

In the present application, the stay is disposed in such a manner that an end on the side of the connecting portion is offset toward the rear of the vehicle relative to the other end on the side of the exhaust fastening portion. This arrangement enables simplification of the shape of the stay and cost reduction by sloping the end of the stay on the side of the exhaust fastening portion.

According to a seventh aspect of the present application, the bracket preferably has a second rib extending in the direction in which an end on the side of the exhaust fastening portion of the stay extends.

In the present application, a second rib extending in the direction in which an end on the side of the exhaust fastening portion of the stay extends is provided in the bracket. This prevents the bracket from being twisted due to the vibrations of the exhaust passage resulting from the vibrations of the catalytic converter or other exhaust emission control device, further enhancing the stiffness of the bracket. Accordingly, the chance of damage can be certainly reduced and the exhaust system can be more robustly supported.

The present application provides an exhaust system supporting structure that can robustly support an exhaust system without any damage sustained even if the exhaust system is far away from the power plant or the body fastening portion.

Obviously, numerous modifications and variations of the present invention are possible in light of the above teachings. It is therefore to be understood that within the scope of the appended claims, the invention may be practiced otherwise than as specifically described herein.

What is claimed is:

1. An internal combustion engine exhaust system supporting structure having an exhaust passage that extends from an internal combustion engine to the rear of a vehicle so as to lead exhaust emissions from the internal combustion engine to the rear of the vehicle and an exhaust emission control device that is provided in the exhaust passage so as to purify exhaust emissions, the structure comprising:

a body fastening portion provided on a power plant or a portion of a vehicle body located on the side of the exhaust passage;

an exhaust fastening portion provided on the top of the exhaust passage;

a bracket having a central body and a first end fastened to the body fastening portion, a first rib protruding from the central body; and a stay that is fastened to the exhaust fastening portion and that has lower stiffness than the bracket, wherein a second end of the bracket and the stay are fastened to each other at a connecting portion, and a vertical distance between the exhaust fastening portion and the connecting portion is configured to be greater than a vertical distance between the body fastening portion and the connecting portion.

2. The internal combustion engine exhaust system supporting structure according to claim 1, wherein the first rib extends from the connecting portion to the body fastening portion, and wherein the first rib extends in a direction substantially perpendicular to a direction in which the exhaust passage vibrates in conjunction with the vibrations of the exhaust emission control device.

3. The internal combustion engine exhaust system supporting structure according to claim 2, wherein the body fastening portion has at least two body fastening seating surfaces spaced apart from each other; and wherein the first rib extends to a connecting surface between the bracket and the power plant or the portion of a vehicle body through a gap between the at least two body fastening seating surfaces.

4. The internal combustion engine exhaust system supporting structure according to claim 1, wherein the bracket has a bracket seating surface formed in the connecting portion; and wherein the bracket has the same width as the bracket seating surface at the connecting portion and widens from the connecting portion toward the body fastening portion.

5. The internal combustion engine exhaust system supporting structure according to claim 1, wherein the exhaust fastening portion has an exhaust fastening seating surface formed of an inclined surface.

6. The internal combustion engine exhaust system supporting structure according to claim 5, wherein the stay is disposed in such a manner that an end thereof on the side of the connecting portion is offset toward the rear of the vehicle relative to another end of the stay on the side of the exhaust fastening portion.

7. The internal combustion engine exhaust system supporting structure according to claim 1, wherein the bracket has a second rib extending in the direction in which an end on the side of the exhaust fastening portion of the stay extends.

8. An internal combustion engine exhaust system supporting structure comprising:

a body fastening portion provided on a power plant or a vehicle body located on a side of an exhaust passage extending from an internal combustion engine to a rear of a vehicle so that exhaust emissions flow from the internal combustion engine to the rear of the vehicle, the exhaust passage having a top outside the exhaust passage in a vertical direction;

an exhaust fastening portion provided on the top of the exhaust passage;

a bracket having a central body and a first end fastened to the body fastening portion, a first rib protruding from the central body; and a stay that is fastened to the exhaust fastening portion and that has lower stiffness than the bracket, a second end of the bracket and the stay being fastened to each other at a connecting portion so that a vertical distance between the exhaust fastening portion and the connecting portion in the vertical direction is greater than a vertical distance between the body fastening portion and the connecting portion in the vertical direction.

9. The internal combustion engine exhaust system supporting structure according to claim 8, wherein the first rib extends from the connecting portion to the body fastening portion, and wherein the first rib extends in a direction substantially perpendicular to a direction in which the exhaust passage vibrates in conjunction with vibrations of an exhaust emission controller provided in the exhaust passage so as to purify exhaust emissions.

10. The internal combustion engine exhaust system supporting structure according to claim 9, wherein the body fastening portion has at least two body fastening seating surfaces spaced apart from each other; and wherein the first rib extends to a connecting surface between the bracket and the power plant or the vehicle body through a gap between the at least two body fastening seating surfaces.

11. The internal combustion engine exhaust system supporting structure according to claim 8, wherein the bracket has a bracket seating surface provided in the connecting portion; and wherein the bracket has a same width as the bracket seating surface at the connecting portion and widens from the connecting portion toward the body fastening portion.

12. The internal combustion engine exhaust system supporting structure according to claim 8, wherein the exhaust fastening portion has an exhaust fastening seating surface having an inclined surface.

13. The internal combustion engine exhaust system supporting structure according to claim 12, wherein the stay is disposed so that an end of the stay on a side of the connecting portion is offset toward the rear of the vehicle relative to another end of the stay on a side of the exhaust fastening portion.

14. The internal combustion engine exhaust system supporting structure according to claim 8, wherein the bracket has a second rib extending in a direction in which an end of the stay on a side of the exhaust fastening portion extends.

15. The internal combustion engine exhaust system supporting structure according to claim 9, wherein the central portion of the bracket includes a plate-shaped portion having an upper surface and a lower surface opposite to the upper surface, and wherein the first rib is provided on the upper surface and the lower surface of the plate-shaped portion so as to penetrate through the plate-shaped portion.

16. The internal combustion engine exhaust system supporting structure according to claim 15, wherein the plate-shaped portion is sloped upward from the connecting portion toward the body fastening portion.

17. The internal combustion engine exhaust system supporting structure according to claim 1, wherein the first rib extends along a surface of the bracket from the first end of the bracket to the second end of the bracket.

18. The internal combustion engine exhaust system supporting structure according to claim 1, wherein the first rib protrudes from the central body in a vertical direction, and wherein the exhaust fastening portion is disposed above the exhaust fastening portion and the connecting portion in the vertical direction.

19. The internal combustion engine exhaust system supporting structure according to claim 8, wherein the first rib extends along a surface of the bracket from the first end of the bracket to the second end of the bracket.

20. The internal combustion engine exhaust system supporting structure according to claim 8, wherein the first rib protrudes from the central body in the vertical direction, and wherein the exhaust fastening portion is disposed above the exhaust fastening portion and the connecting portion in the vertical direction.

* * * * *